US006679329B2

(12) United States Patent
Murray et al.

(10) Patent No.: US 6,679,329 B2
(45) Date of Patent: Jan. 20, 2004

(54) SAND BARRIER FOR A LEVEL 3 MULTILATERAL WELLBORE JUNCTION

(75) Inventors: Douglas J. Murray, Humble, TX (US); John J. Johnson, Montgomery, TX (US); Enrique M. Proano, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 58 days.

(21) Appl. No.: 10/053,832

(22) Filed: Jan. 22, 2002

(65) Prior Publication Data

US 2002/0100588 A1 Aug. 1, 2002

Related U.S. Application Data

(60) Provisional application No. 60/264,371, filed on Jan. 26, 2001.

(51) Int. Cl.[7] ..... E21B 29/06

(52) U.S. Cl. ..... 166/313; 166/50; 166/207

(58) Field of Search ..... 166/313, 50, 117.6, 166/381, 387, 207

(56) References Cited

U.S. PATENT DOCUMENTS 6,119,771 A 9/2000 Gano et al.
6,209,644 B1 * 4/2001 Brunet ..... 166/297
6,279,659 B1 8/2001 Brunet ..... 166/313
6,283,208 B1 * 9/2001 George et al. ..... 166/255.3
6,419,026 B1 * 7/2002 MacKenzie et al. ..... 166/381

FOREIGN PATENT DOCUMENTS

| | | |
|---|---|---|
| GB | 2304764 | 3/1997 |
| GB | 2 332 462 | 6/1999 |
| GB | 2345933 | 7/2000 |
| GB | 2 363 139 | 12/2001 |
| GB | 2363142 | 12/2001 |
| WO | WO 98/09049 | * 3/1998 |
| WO | WO 02/02900 | 1/2002 |

OTHER PUBLICATIONS

Search Report.

* cited by examiner

*Primary Examiner*—William Neuder
(74) *Attorney, Agent, or Firm*—Cantor Colburn LLP

(57) ABSTRACT

A relatively thin walled sleeve having a premachined window is disposed at a casing window in a wellbore. The sleeve is set in place with the casing or on a separate run wherein the running tool also includes a dog to align the sleeve premachined window with the casing window both linearly and rotationally in the wellbore. The sleeve is swedged in place in part or completely and a subsequent run provides a lateral liner which extends through both the premachined window and the casing window and seals against the premachined window which will then prevent sand entering the wellbore.

18 Claims, 9 Drawing Sheets

SAND BARRIER FOR A LEVEL 3 MULTILATERAL WELLBORE JUNCTION

CROSS REFERENCE TO RELATED APPLICATIONS

This application claims the benefit of an earlier filing date from U.S. Provisional Application Serial No. 60/264,371 filed Jan. 26, 2001, the entire disclosure of which is incorporated herein by reference.

BACKGROUND OF THE INVENTION

A multilateral wellbore system by definition includes at least a primary wellbore and a lateral wellbore extending therefrom. The junction between the primary wellbore and the lateral wellbore in some cases is an avenue for sand and other particulate matter infiltration into the wellbore system which generally results in the entrainment of such particulate matter with the production fluid. Clearly, it is undesirable to entrain particulate matter in production fluid since those particulates would then need to be removed from the production fluid adding expense and delay to a final release of a product. The reasons for particulate infiltration through a junction in a multilateral wellbore are many, including the not entirely controllable window size and shape which is generated by running a milling tool into the primary wellbore and into contact with a whipstock whereafter the mill tool mills a window in the casing of the primary wellbore. The milling process itself is not precise and thus it is relatively unlikely that a precise window shape and size can be produced. Lateral liners run in to extend through a milled window and into a lateral borehole are constructed with regular patterns and sizes at the surface. When a regular pattern at the top of such a liner is seated against a milled window in the downhole environment, it is relatively unlikely that the liner flange will seat correctly in all regions of a milled window. This leaves gaps between the flange of the liner and the milled casing in the primary wellbore resulting in the aforesaid avenue for infiltration of particulate matter to the wellbore system. A device and method capable of reducing the amount of particulate matter infiltrating the wellbore system at a junction in a multilateral wellbore will be beneficial to downhole arts.

SUMMARY OF THE INVENTION

Sand and other particulate matter is significantly excluded from junctions in level 3 multilateral wellbore systems by employing a thin walled sleeve having a premachined window therein in conjunction with the conventional milling of a window in the primary wellbore casing. The premachined window exhibits a known and easily controlled shape and size which lends itself to assurance that a commercially available liner hanger will seal thereagainst since the liner hanger and the sleeve are machined in controlled conditions at the surface for the purpose of sealing with one another. The installation of the sleeve with the premachined window ensures that at the ID of the wellbore casing, the window surface "seen" by the liner hanger system is one against which the liner hanger system is sealable. The seal of the liner hanger may be by any number of methods, two preferred methods being by an elastomeric seal placed between the flange of the liner hanger and the sleeve, and a metal-to-metal interference fit resulting in deformation of the window sleeve outward during installation of the liner. In addition a hook liner hanger embodiment is disclosed. All of these alternate methods of providing a seal are effective and each have benefits which are attractive for certain applications. The sleeve is preferably swaged at an uphole end thereof, a downhole end thereof, both or in its entirety depending upon the application and desires of the operator. In one embodiment, the casing itself of the primary wellbore is provided with a cylindrical recess capable of receiving the sleeve such that the ID of the sleeve is substantially the same diameter as the ID of the casing.

BRIEF DESCRIPTION OF THE DRAWINGS

Referring now to the drawings wherein like elements are numbered alike in the several Figures.

DETAILED DESCRIPTION OF THE INVENTION

Figure 1:
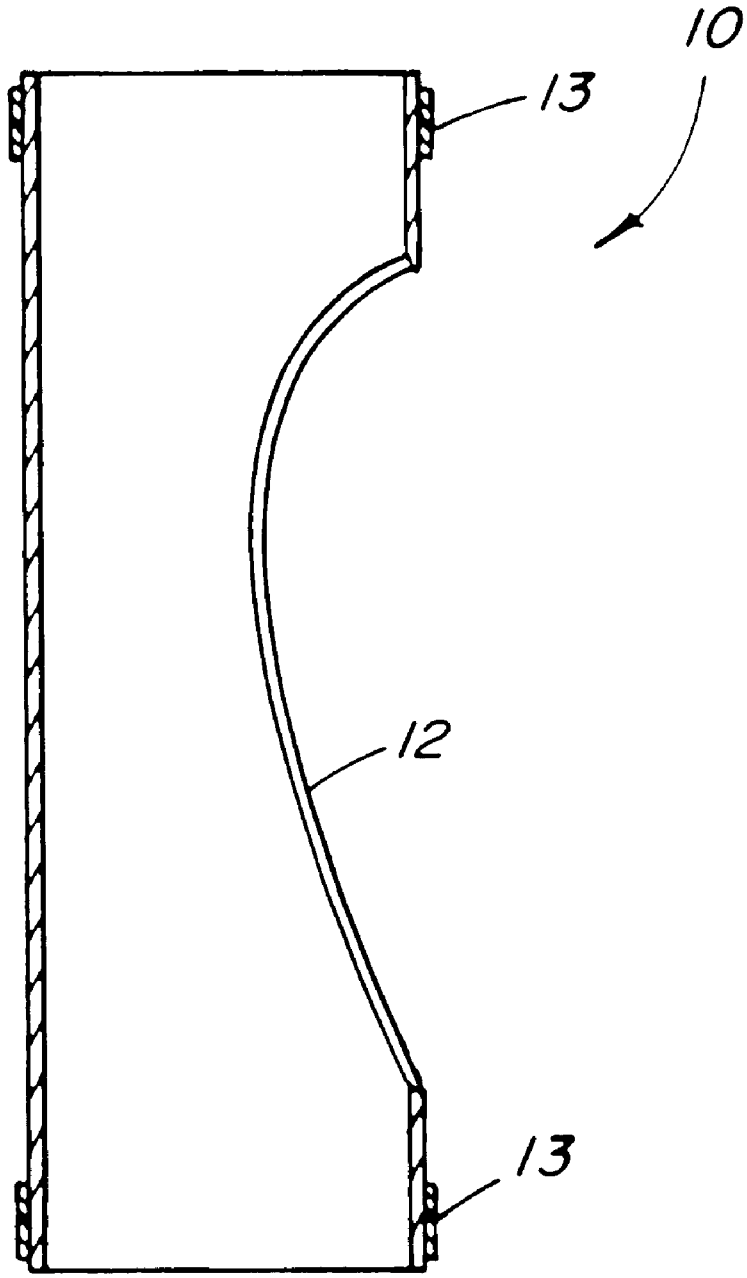
FIG. 1 is a cross-section view of a thin walled sleeve with premachined window.

Referring to FIG. 1, a thin walled sleeve 10 is illustrated having a premachined window 12. Sleeve 10 is preferably constructed of steel with a thickness of from 0.125 inch to 0.250 inch. A preferred thickness of 0.197 inch is selected to facilitate relatively easy swaging yet provide sufficient resiliency in the sleeve to ensure a close proximity of a liner extending therethrough to said sleeve sufficient to facilitate bridging of a particular matter which would otherwise pass between said sleeve and said liner to contaminate produced fluids. In another preferred embodiment the liner is sealed against said sleeve. In a preferred embodiment, bands 13 are positioned around sleeve 10 to aid in sealing and anchoring sleeve 10 against casing 20. Bands 13 are preferably elastomeric. It should be understood that one or more bands 13 may be employed as desired. The bands are visible in FIGS. 1, 2 and 10 but are not visible in other figures because they are compressed between sleeve 10 and the casing of the borehole.

Figure 2:
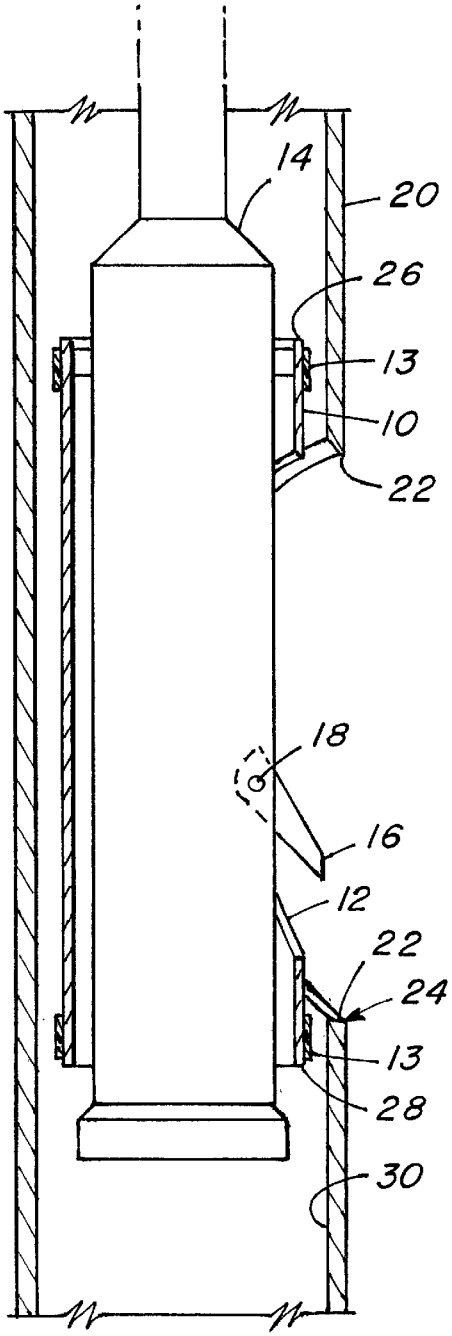
FIG. 2 is a cross-section view of the thin walled sleeve installed on a running tool which is illustrated schematically, the running tool including a locating dog.

FIG. 2 schematically illustrates a running tool 14 on which sleeve 10 is mounted for being run into the hole (not shown). Running tool 14 may be any one of several commercially available running tools capable of releasably retaining a sleeve to be run downhole. Running tool 14 does however include a schematically illustrated locating dog 16 unique to applications of the thin walled sleeve 10. Locating dog 16 preferably is mounted on pin 18 which includes a torsional spring (not shown). Locating dog 16 follows an ID of a casing 20 until it reaches a milled window 22 whereat locating dog 16 automatically protrudes through window 22 while running tool 14 proceeds farther downhole. As locating dog 16 reaches a lower vee 24 of window 22, it will orient itself both linearly and rotationally to window 22. Because sleeve 10 is carefully oriented on running tool 14 at the surface to place locating dog 16 in a selected position relative to premachined window 12, the action of locating dog 16 in vee 24 linearly and rotationally orients sleeve 10 to the milled window 22.

Figure 3:
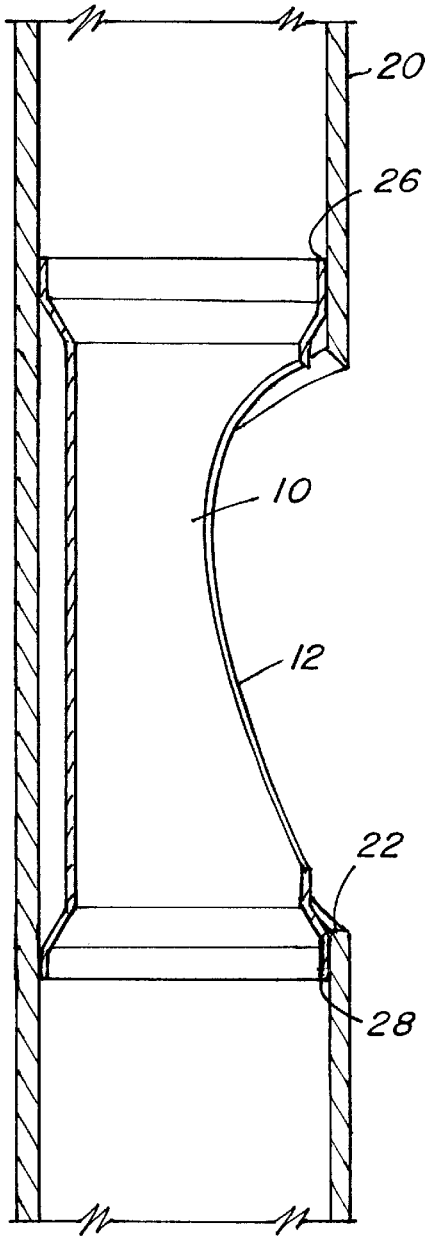
FIG. 3 is a schematic illustration of the thin walled sleeve installed with the uphole and downhole sections of the sleeve swaged against the ID of the casing.

Once sleeve 10 is oriented properly within the hole, running tool 14 is used to swage an uphole end 26, a downhole end 28 or both 26 and 28 into contact with an ID 30 of casing 20. One preferred method for swaging sleeve 10 is to employ an inflatable swaging device incorporated into the running tool. If both uphole end 26 and downhole end 28 are intended to be swaged then preferably two inflatable tools will be utilized simultaneously. FIG. 3 illustrates, schematically, sleeve 10 swaged at uphole end 26 and downhole end 28.

Figure 4:
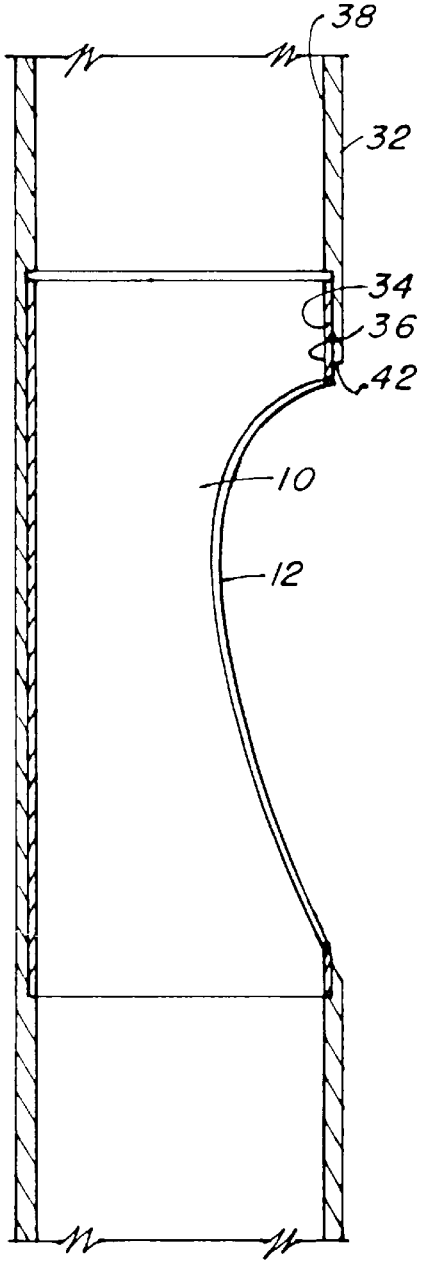
FIG. 4 is an illustration in cross-section of the thin walled sleeve installed in a fully swaged condition against the ID of the casing wherein an alternate casing segment is employed having a recess to accept the thin walled sleeve.

Referring to FIG. 4, an alternate construction for new wells is disclosed wherein casing 32 is premachined with a window and includes recess 34 which is of sufficient dimension and configuration to receive a preinstalled sleeve 10 while providing an ID 36 of sleeve 10 which substantially equals ID 38 of casing 32. By employing such casing 32 there is no restriction at the junction which might otherwise be problematic with respect to tools passing through the junction. As best illustrated in FIGS. 3 and 4, window 12 in sleeve 10 is preferably of smaller dimension than the window 22 (in FIG. 3) and 42 (in FIG. 4) so that a lateral liner being urged into a sealing engagement at the junction will seal against the ID 36 of sleeve 10 at window 12.

Figure 5:
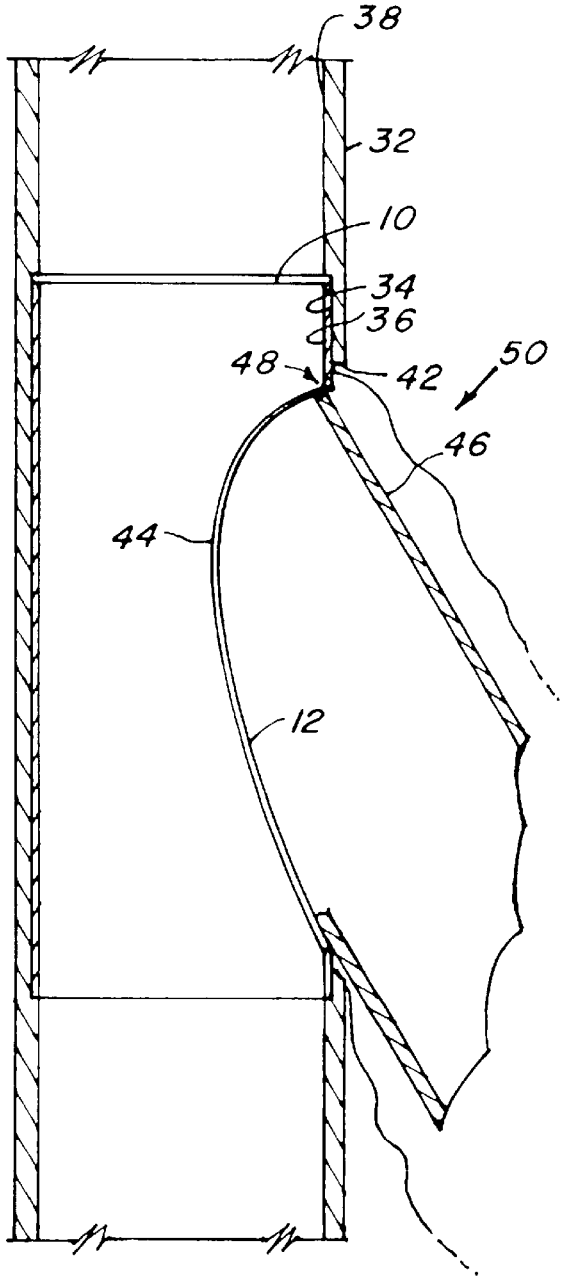
FIG. 5 is an illustration similar to FIG. 4 with the lateral liner installed.

Referring to FIG. 5, the depiction of FIG. 4 has been repeated but with a lateral liner installed. Thus, it is illustrated that flange 44 of lateral liner 46 is seated against the window 12 in sleeve 10 and is sealed thereto. It should be noted that at the interface (arrow 48) may be an elastomeric sealing material such as polyurethane or a metal sealing material such as bronze or steel. It should also be noted that it is possible to machine the premachined window 12 slightly smaller than liner 46 to provide an interference fit with the liner 10. Because of the proximity of the sleeve to the liner in the area of the premachined window, sand and other particulate matter from the area of the junction 50 is substantially excluded from the wellbore system. This can be by one of bridging or sealing depending upon the tightness of the liner against the sleeve.

Figure 6:
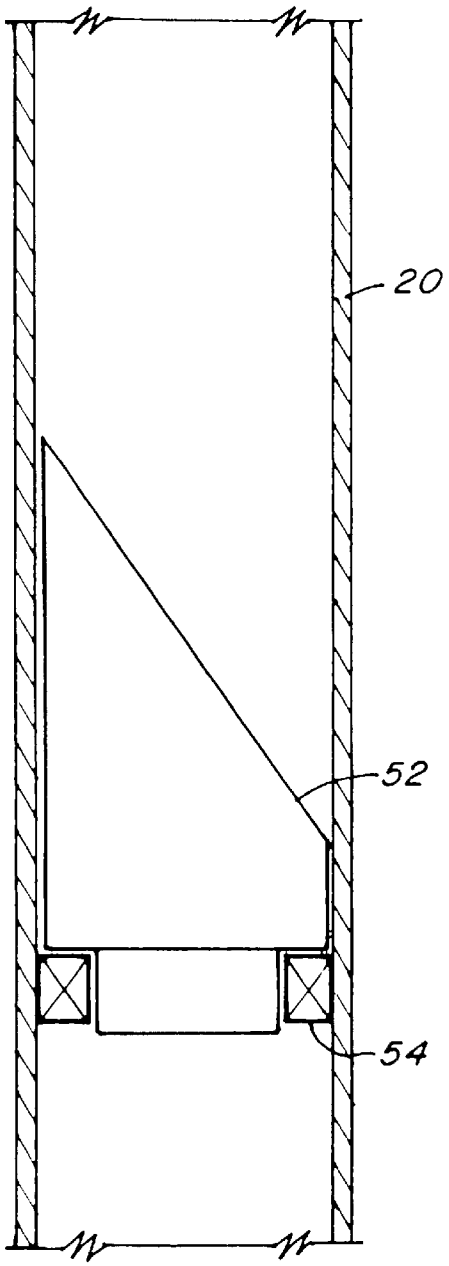
FIG. 6 is a view of a section of a primary casing with a whipstock installed therein prior to milling the primary casing.
Figure 7:
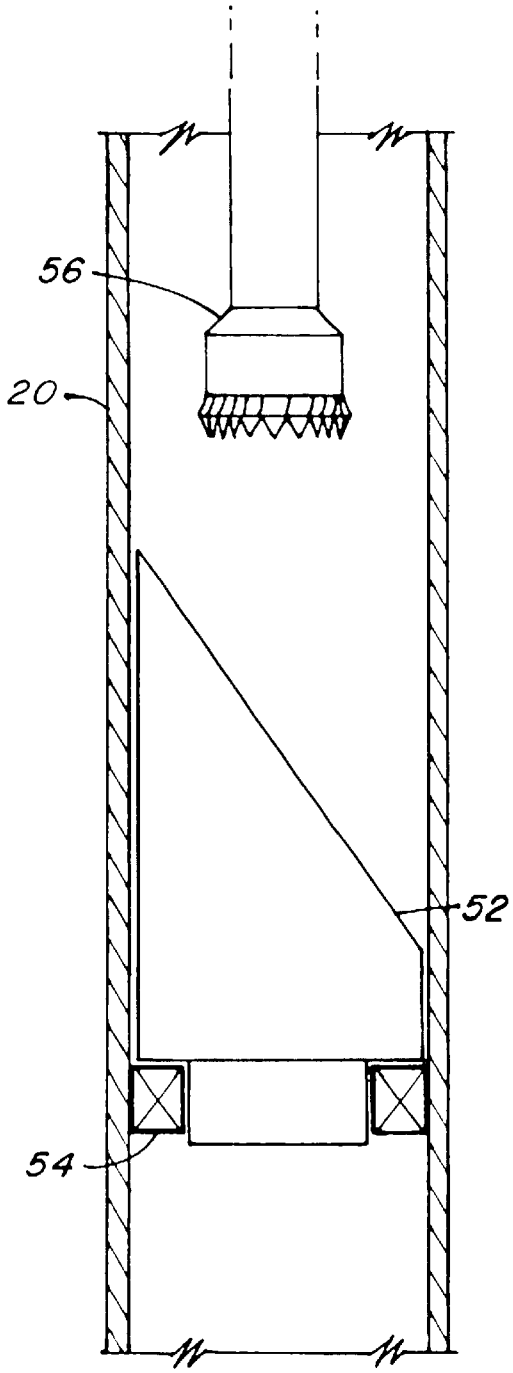
FIG. 7 is an illustration similar to FIG. 6 but illustrating the drill bit being run downhole.
Figure 8:
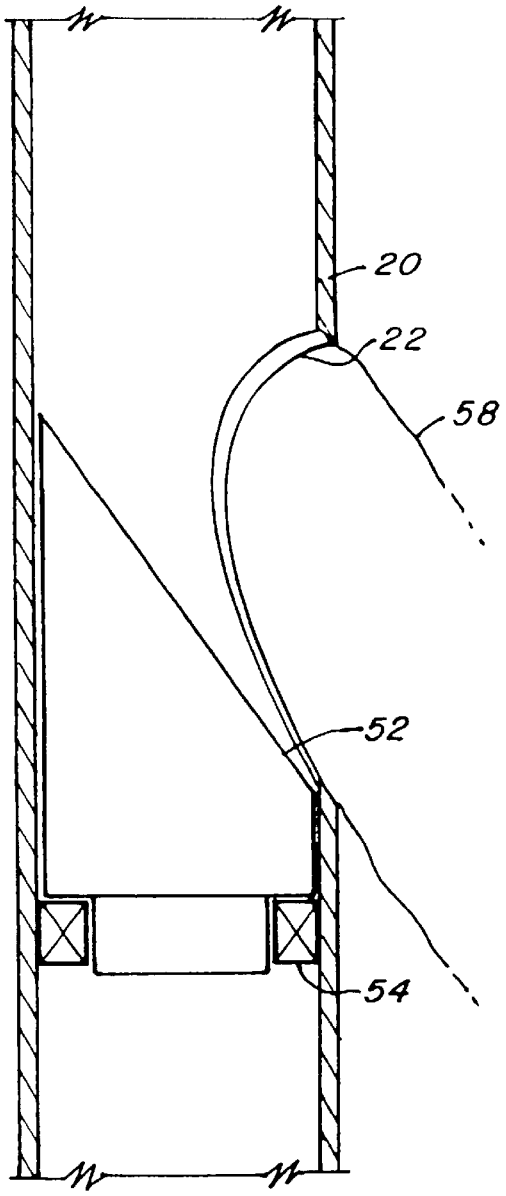
FIG. 8 illustrates the primary casing after drilling creating a window in the primary casing and a lateral borehole.
Figure 9:
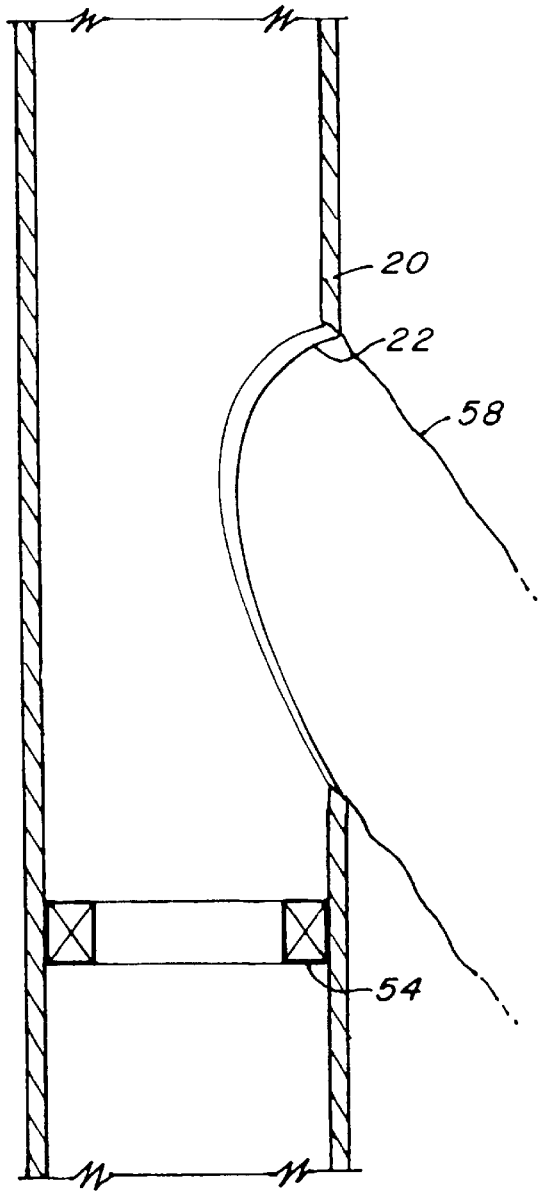
FIG. 9 illustrates the view of FIG. 8 after the whipstock is removed.
Figure 10:
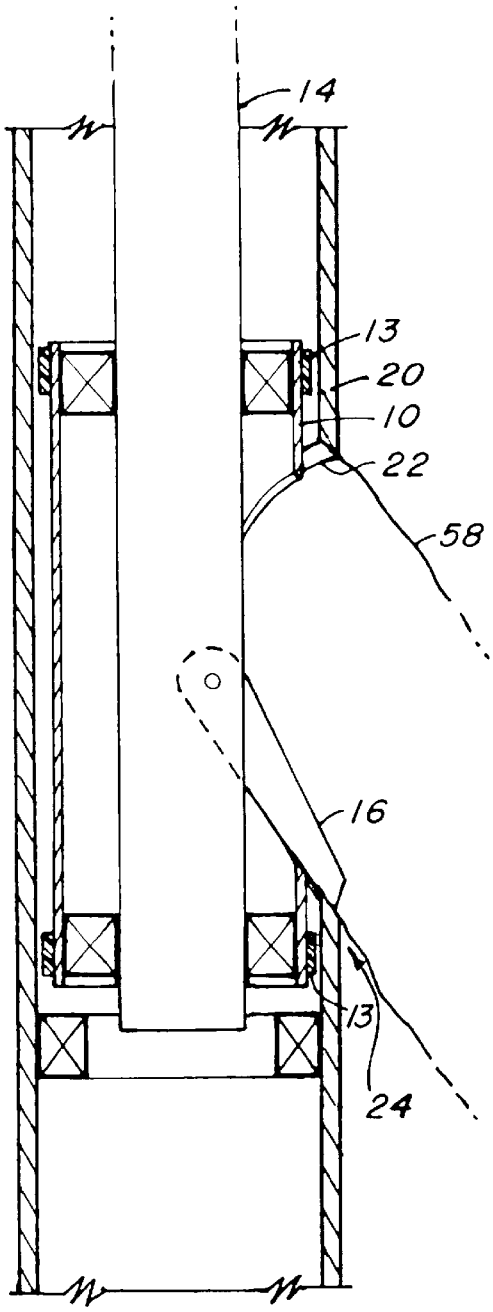
FIG. 10 is an illustration of the sleeve being located at the junction interface with a running tool.
Figure 11:
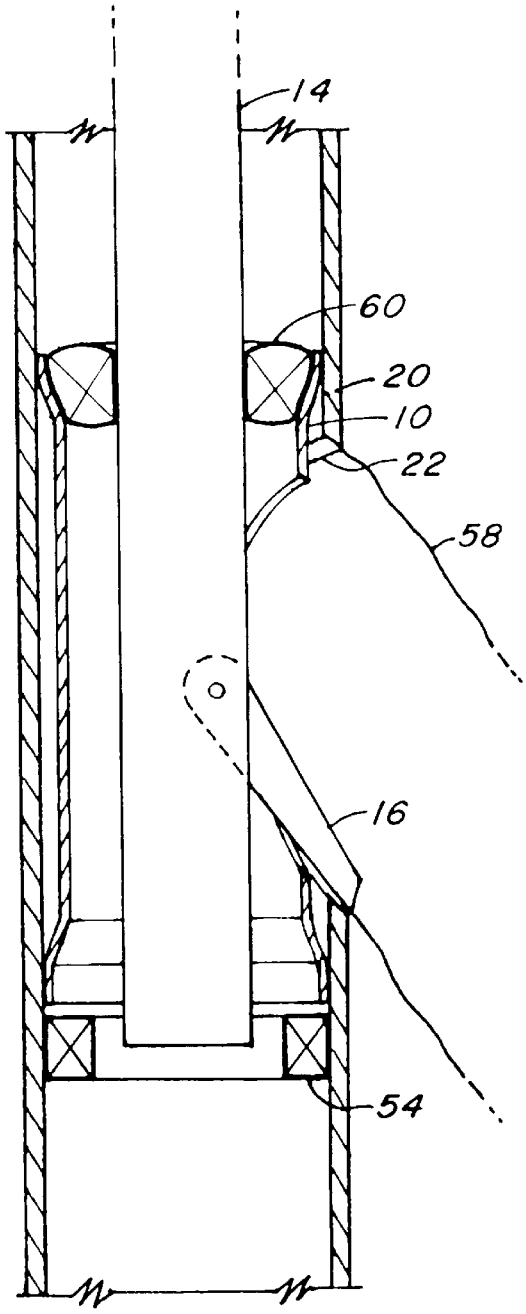
FIG. 11 illustrates the running tool swaging and uphole end of the thin walled sleeve against the casing ID.
Figure 12:
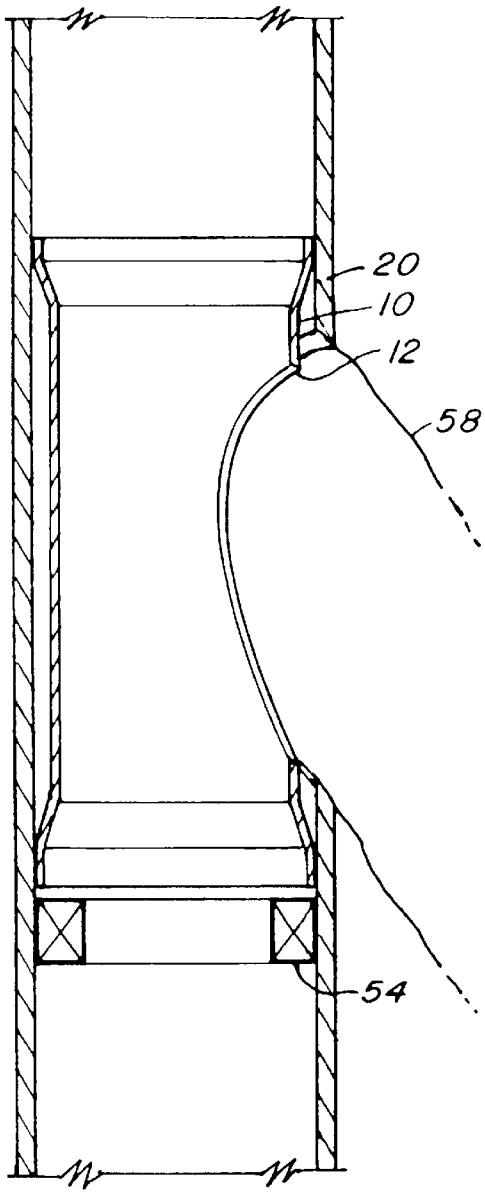
FIG. 12 illustrates the sleeve in position within the wellbore.
Figure 13:
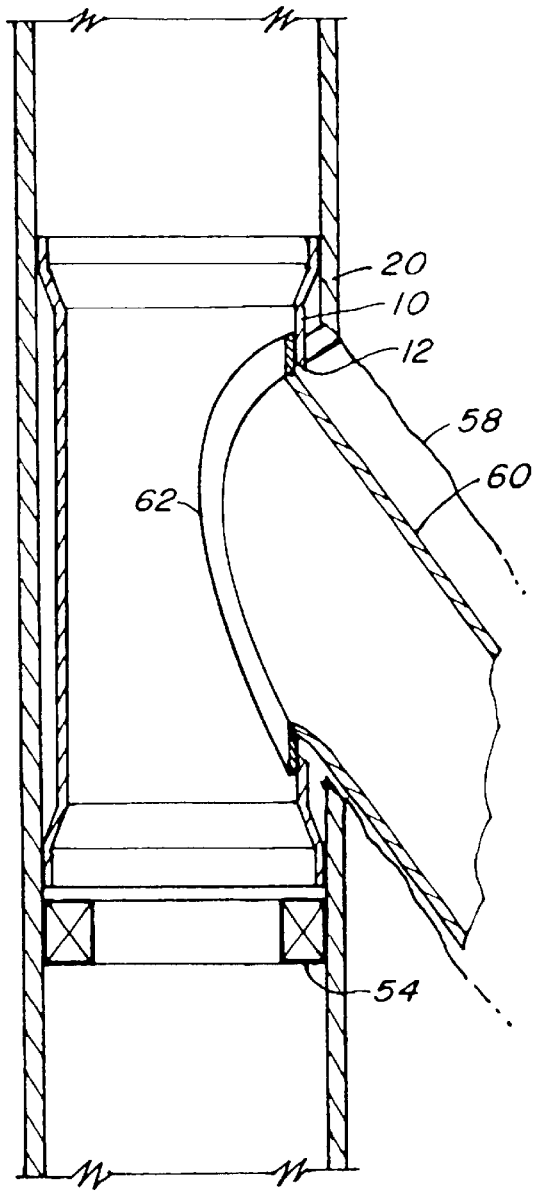
FIG. 13 is a similar view to FIG. 12 with the lateral liner installed therein.

Referring to FIGS. 6–13, a sequential illustration of one embodiment for installing the sand device is illustrated. In FIG. 6, casing 20 is illustrated with a whipstock 52 therein oriented and maintained in place by anchor 54. In FIG. 7, a drill string 56 is illustrated being introduced to the downhole environment just prior to contact with whipstock 52. Referring to FIG. 8, a milled window 22 and lateral borehole 58 are illustrated. Referring to FIG. 9, the whipstock 52 has been removed from the wellbore leaving anchor 54 in place. It should be noted that anchor 54 is not required for installation of the sand exclusion device described herein but could be used if desired as a locating device. Referring to FIG. 10, a running tool 14 as described hereinabove, has been introduced to the downhole environment and into the vicinity of lateral borehole 58. Dog 16 orients linearly and rotationally to milled window 22. Once dog 16 has landed in vee 24, as described above, the sleeve 10 is swaged with inflatable packer 60 which is illustrated in FIG. 11. Referring to FIG. 12, the swaged sleeve 10 is left in position within the wellbore and anchored to casing 20 with window 12 oriented linearly and rotationally to borehole 58. FIG. 13 illustrates a lateral liner 60 installed with flange 62 firmly seated against sleeve 10 and creating a seal thereagainst with either an elastomeric sealant such as polyurethane, metal-to-metal seal or other suitable seal.

Figure 14:
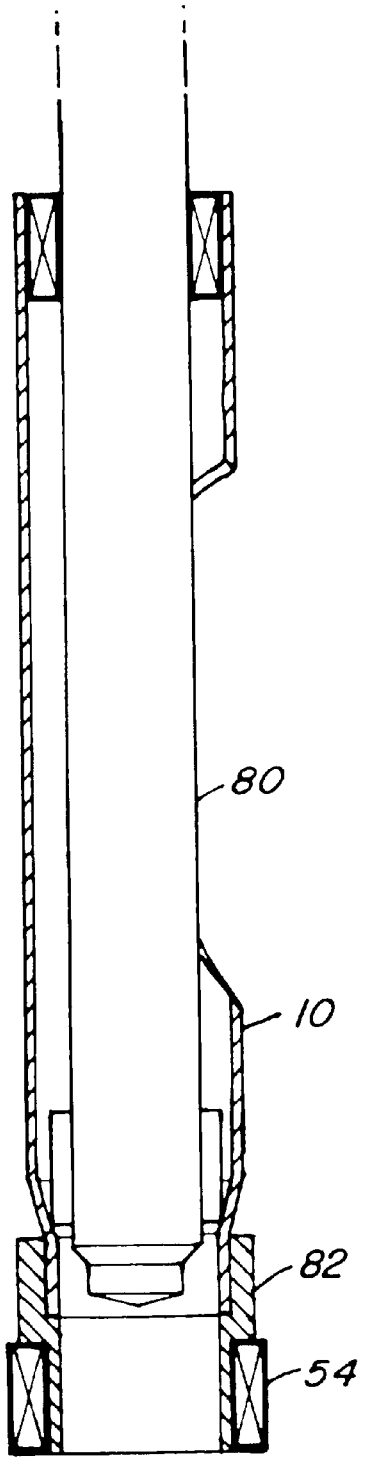
FIG. 14 is a schematic view of an alternate embodiment of the sleeve employing an orientation anchor.
Figure 15:
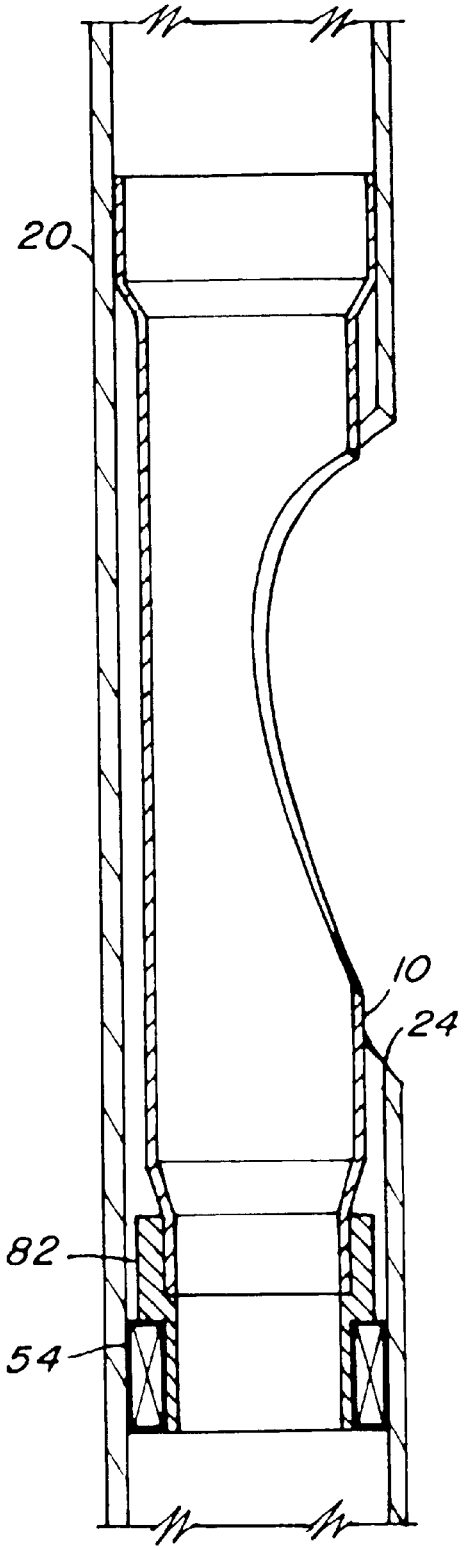
FIG. 15 is a view of the FIG. 14 embodiment after swedging of the uphole end.

The above discussed method for orienting rotationally and linearly using dog 16, while a preferred embodiment, is but one embodiment. Another preferred embodiment referring to FIGS. 14 and 15 is to stab into anchor 54 with a running tool 80 having an orientation anchor 82 so that sleeve 10 is orientable to the milled window (not shown in subject figure) based upon the original whipstock anchor 54 and not the vee 24 of the window. The orientation anchor 82 further seals the downhole end and thus removes the need to swage the downhole end of sleeve 10. The uphole end therefore is the only end needing swaging. FIG. 15 illustrates the uphole end swaged as has been previously described herein.

Figure 16:
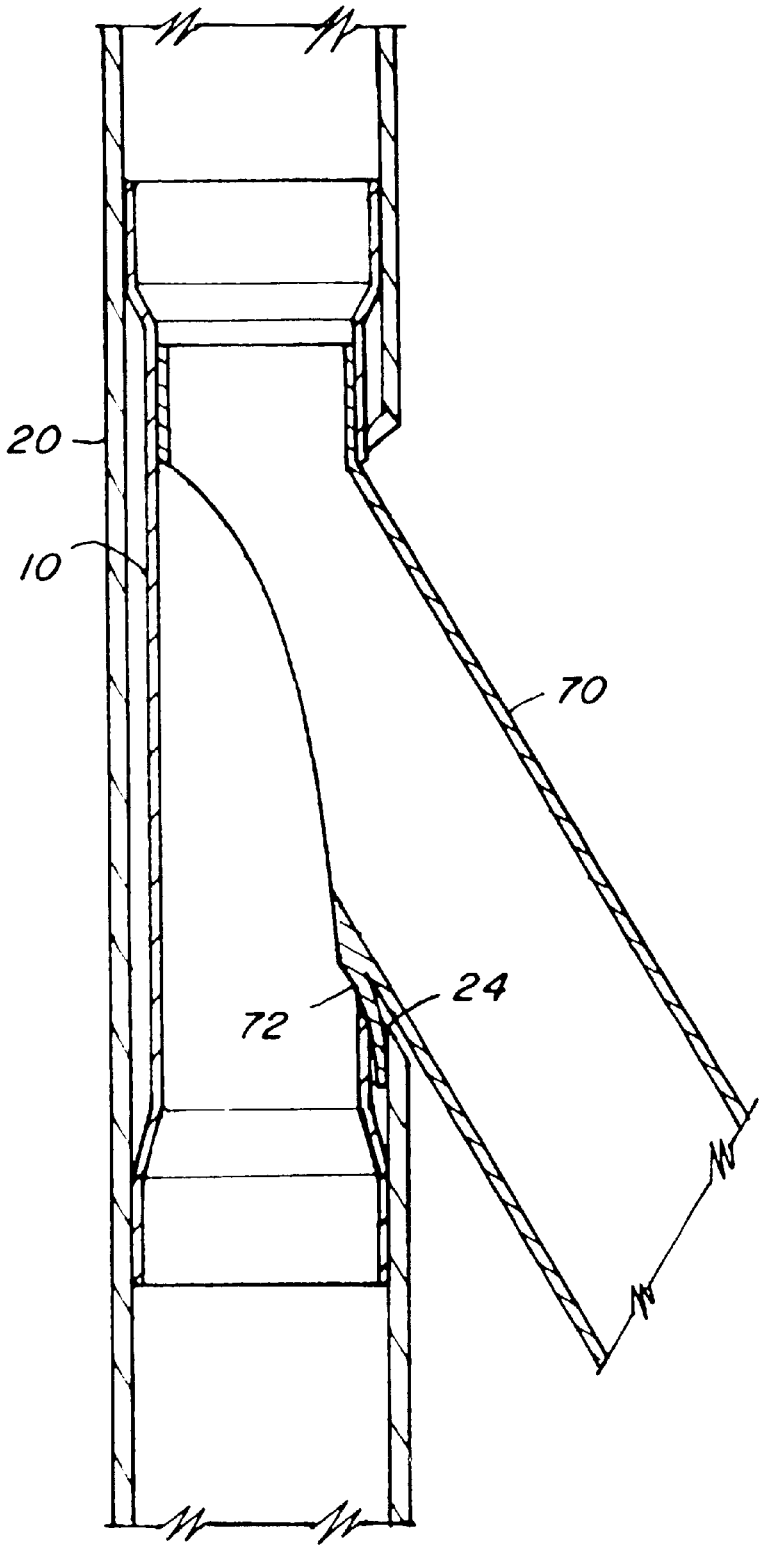
FIG. 16 is a schematic section view of an embodiment employing a hook liner hanger.

In another embodiment referring to FIG. 16, a schematic illustration carrying identical numerals for identical components is provided for understanding of another preferred arrangement where the sand exclusion sleeve 10 is employed in connection with a hook hanger liner 70 having hook 72 to engage with vee 24. Although a flange 44 is not available in this embodiment, an interference fit between liner 70 and sleeve 10 is nevertheless crated which causes the bridging of particulates and thus their exclusion from the junction.

It should be noted that while the foregoing method for creating a sand excluding junction is effective, it is only necessary to place the sleeve 10 at a desired location, and run a liner through the premachined winds and into close enough proximity therewith to facilitate bridging of particulate matter. Swaging the sleeve in place is a preferred operation as well. Milling of a window in the primary casing and drilling a lateral borehole may have been accomplished as part of an earlier operation.

While preferred embodiments of the invention have been shown and described, various modifications and substitutions may be made thereto without departing from the spirit and scope of the invention. Accordingly, it is to be understood that the present invention has been described by way of illustration and not limitation.

What is claimed:

1. A multilateral wellbore junction comprising:

a primary wellbore casing;

a window through said casing;

a lateral wellbore extending from said window;

a sleeve having a window therein oriented to said window through said casing; said sleeve having an outside diameter equal to or smaller than an inside diameter of said casing; and a lateral liner proximately disposed to said sleeve and extending into said lateral borehole.

2. A multilateral wellbore junction as claimed in claim 1 wherein said sleeve is a thin walled sleeve.

3. A multilateral wellbore junction as claimed in claim 1 wherein said sleeve further includes at least one band therearound.

4. A multilateral wellbore junction as claimed in claim 3 wherein said at least one band is elastomeric.

5. A multilateral wellbore junction as claimed in claim 1 wherein said sleeve is constructed of steel.

6. A multilateral wellbore junction as claimed in claim 1 wherein said sleeve is swaged against an ID of said casing.

7. A multilateral wellbore junction as claimed in claim 1 wherein said premachined window is of smaller dimensions than said window through said casing.

8. A method for excluding particulate entry to a wellbore system at a lateral junction thereof comprising:

running a sleeve having a premachined window therein to a location within the wellbore where a casing window exists; and installing a lateral liner through said premachined window and said casing window, the liner being proximately disposed to said premachined window in said sleeve.

9. A method for excluding particulate entry to a wellbore system as claimed in claim 8 wherein said method further includes, prior to running said sleeve, milling a window in a primary casing of said wellbore.

10. A method for excluding particulate entry to a wellbore system as claimed in claim 8 wherein said method further includes orienting said premachined window to said casing window.

11. A method for excluding particulate entry to a wellbore system as claimed in claim 8 wherein said method further includes installing said sleeve.

12. A method for excluding particulate entry to a wellbore system as claimed in claim 11 wherein said installing said sleeve includes swaging said sleeve into contact with an ID of said wellbore at one of an uphole end of said sleeve, a downhole end of said sleeve, and both an uphole and downhole end of said sleeve.

13. A method for excluding particulate entry to a wellbore system as claimed in claim 8 wherein said installing said liner includes facilitating bridging of particulate matter which otherwise would flow through said liner and said sleeve.

14. A method for excluding particulate entry to a wellbore system as claimed in claim 8 wherein said installing includes sealing said liner to said sleeve.

15. A particulate matter exclusion device for completing a junction in a hydrocarbon well in cooperating with a liner, said device comprising:

a sleeve having a relatively thin wall thickness, said sleeve prior to installation having an outside diameter of equal to or less than an inside diameter of a casing segment into which said sleeve is configured to be installed;

a window machined in said sleeve at a surface environment.

16. A particulate matter exclusion device for completing a junction as claimed in claim 15 wherein said device further includes at least one band disposed around a perimeter of said sleeve.

17. A particulate matter exclusion device as claimed in claim 15 wherein said wall thickness is about 0.125 inch to about 0.250 inch.

18. A particulate matter exclusion device as claimed in claim 15 wherein said band is elastomeric.

* * * * *